United States Patent [19]

Barnes

[11] Patent Number: 4,485,781

[45] Date of Patent: Dec. 4, 1984

[54] ENGINE PROTECTION DEVICE

[76] Inventor: Richard W. Barnes, 301 N. 67 Ave., Hollywood, Fla. 33024

[21] Appl. No.: 494,856

[22] Filed: May 16, 1983

[51] Int. Cl.[3] ..... F02D 17/04

[52] U.S. Cl. ..... 123/342; 123/198 D

[58] Field of Search ..... 123/342, 198 D

[56] References Cited

U.S. PATENT DOCUMENTS 3,923,020 12/1975 Gilligan ..... 123/342
3,952,714 4/1976 Weyer ..... 123/342
4,126,114 11/1978 Davis ..... 123/198 D
4,399,785 8/1983 Mills ..... 123/198 D X

*Primary Examiner*—William A. Cuchlinski, Jr.
*Attorney, Agent, or Firm*—Eugene F. Malin

[57] ABSTRACT

An engine protection device to automatically reduce engine speed to low idle or complete stop. Engine speed reduction is accomplished through the instrumentalies associated with the engine throttle rod. The effective length of the engine rod varies in response to an increase in the coolant temperature or a decrease engine oil pressure.

5 Claims, 2 Drawing Figures

ENGINE PROTECTION DEVICE

BACKGROUND OF THE INVENTION

Existing internal combustion devices promote engine shut-down in the event of a failure in engine oil pressure, as shown in U.S. Pat. No. 4,080,946. The engine shut-down function results in a complete shut-down which requires a repriming of the fuel system before the vehicle can be moved by its own power. Additionally, such engine shut-down systems require valves, switches, gauges, relays and coils. These component ports are subject to corrosion and malfunction which results in a inoperative system.

SUMMARY OF THE INVENTION

The present invention provides an engine protection system that will allow the engine to idle allowing the operator to move the vehicle out of traffic patterns. The present invention provides a fluid or air pressure activated cylinder in series with the engine throttle rod to mechanically vary the length of the engine throttle rod or cable to limit or stop the (Available) engine speed. It is an object of this invention to provide an engine protection device which includes a fluid or air pressure activated cylinder interposed in series in the engine throttle rod operative to mechanically vary its effective length to limit or stop the available engine speed this being determined by the engine application.

It is a further object of this invention to provide an effective, practical, reliable and durable engine protection system.

It is yet another object of this invention to provide an engine protection system which uses air and/or oil to regulate engine throttle length.

It is yet another object of this invention to provide a system that is economical to manufacture.

It is yet another object of this invention to minimize the damage and its related repair and replacement costs of internal combustion engines which arises because of increased coolant temperature and/or decreased oil pressure.

The instant invention has been shown and described herein in what is considered to be the most practical and preferred embodiment. It is recognized, however, that departures may be made therefrom within the scope of the invention and that obvious modifications may occur to a person skilled in the art.

DESCRIPTION OF THE PREFERRED EMBODIMENT

Figure 1:
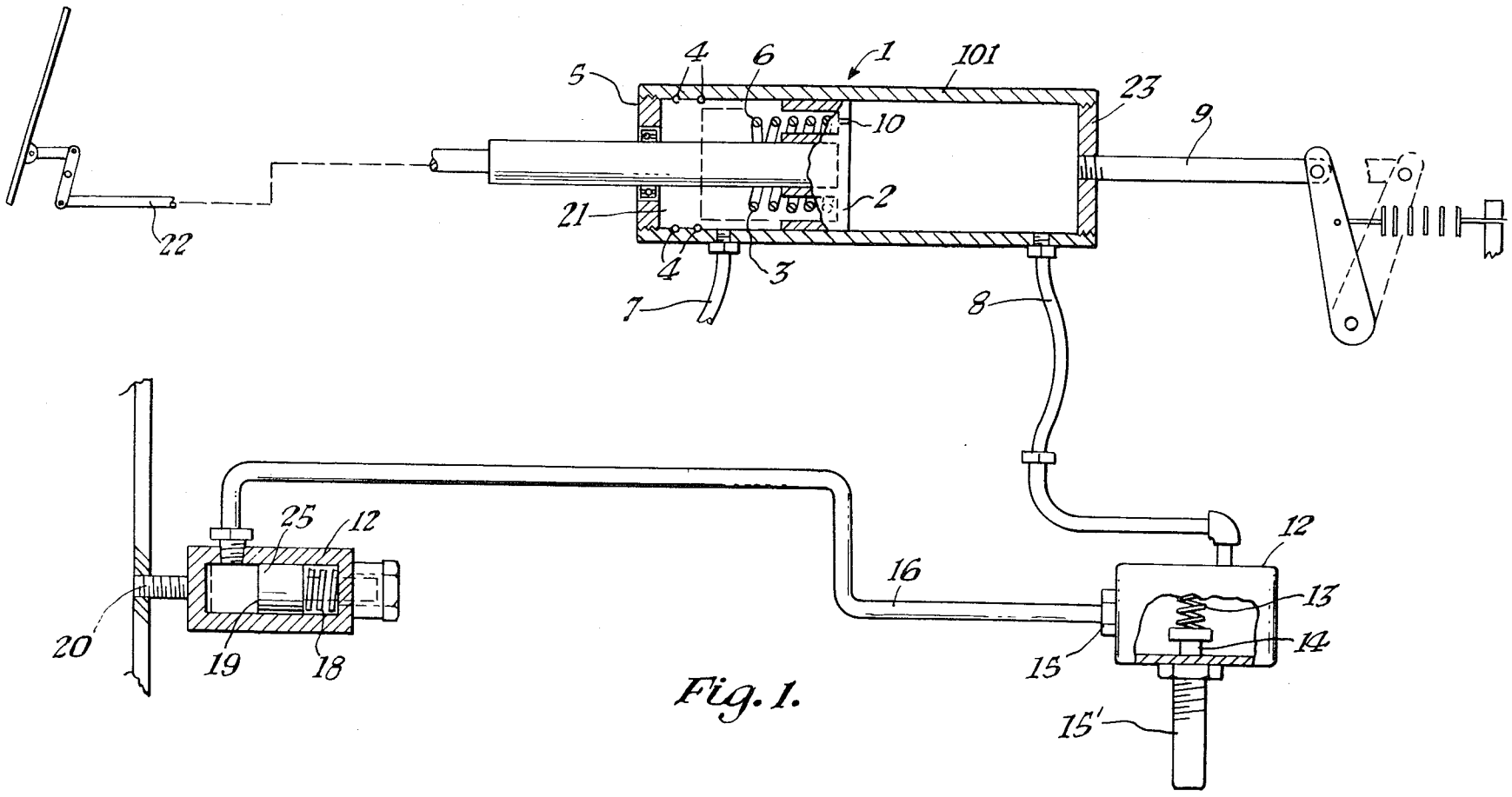
FIG. 1 is a partial sectional schematic showing the engine protection device with oil pressure lines.

Referring now more particularly to the drawings in FIG. 1 and to the characters of the reference marked there on the engine protection device as used in association with an internal combustion engine, which includes a engine govener level, moveable in a speed increase direction by a connecting throttle rod or cable 9 being actuated from operators control lever by a rod 22 connected between said control lever and control rod 9.

The engine protection device comprises a relatively small diameter, enlongated hydraulic cylinder assembly 1. Said hydraulic cylinder assembly 1 includes a tubular body 101, threaded end plug 23, oil seal 21, a bushing 24 retained by snap rings 5 and sealed with O rings 4, and a piston 2. The related split end portion of the throttle rod 22, forming the piston rod of the cylinder 32, slidable extending in sealed relation through the bushing 24, and inwardly there of being attached to the piston 2. The other split end portion of the throttle rod 9 is secured to the end plug 23, a return spring 6 is to urge cylinder control rod 22 to its idle or stop position.

A first conduit 8 is attached to the hydraulic cylinder assembly 1 and thence leads to connection 11 to oil feed in relation to oil pressure valve 17, and open thermo value 12. A second conduit 7 returns the oil to the crankcase, portion 7' of conduit 7 and portion 8' of conduit 8 are flexible to permit free longitudinal motion of the hydraulic cylinder assembly 1 with the throttle rod or cable 9.

An oil pressure valve 17 connected to a source of hydraulic pressure on the engine is used to regulate oil flow through conduit 16. Oil enters the hydraulic cylinder assembly 1 through open thermo valve 12 after passing through conduit 11 and 8. Oil under pressure then forces piston 2 and control rod 22 to its operating position while compressing return spring 3. A small orifice 10 is in upper piston surface 2 to allow a small amount of leakage needed to allow piston 2 and connecting rod 22 to return to low idle or stop position should low oil pressure or excessive coolant temperature occur.

The oil pressure valve 17 has a piston 19 and spring 18, the piston face being urged against its seat machined in valve body 17. Oil under pressure forces the piston to compress spring 18 uncovering outlet port. The amount of oil pressure required to open valve 17 can be regulated by installing shims 25 of desired thickness between piston end 19 and piston spring 18.

When the engine is in normal use the oil pressure valve 17 remains open, should engine oil pressure fall to predetermined level, piston 19 inside oil pressure valve 17 will be urged against its seat by spring 18 causing oil flow to the hydraulic cylinder assembly 1 to stop causing the hydraulic cylinder assembly 1 to contract bringing engine to low idle or stop.

The thermo valve 12 is attached by pipe thread 15 to engine cylinder head 17 or water manifold (not shown). The heat sensor of the thermo valve 12 being immersed in engine water coolant. Oil under pressure flows through conduit 16, into thermo valve 12 which is normally open then through conduit 11 and flexible conduit 8 into the hydraulic cylinder assembly 1. This oil under pressure will extend the hydraulic cylinder assembly 1 into its working length. Should engine coolant temperature rise above predetermined level, valve 14 will compress spring 13 until valve 14 is firmly against its seat thereby stopping oil flow to the hydraulic cylinder assembly 1. Oil trapped in the hydraulic cylinder assembly 1 will flow through orifice 10. This oil then drains through conduit 7 to engine crank case as the elongated cylinder contract, bringing engine to idle or stop.

Figure 2:
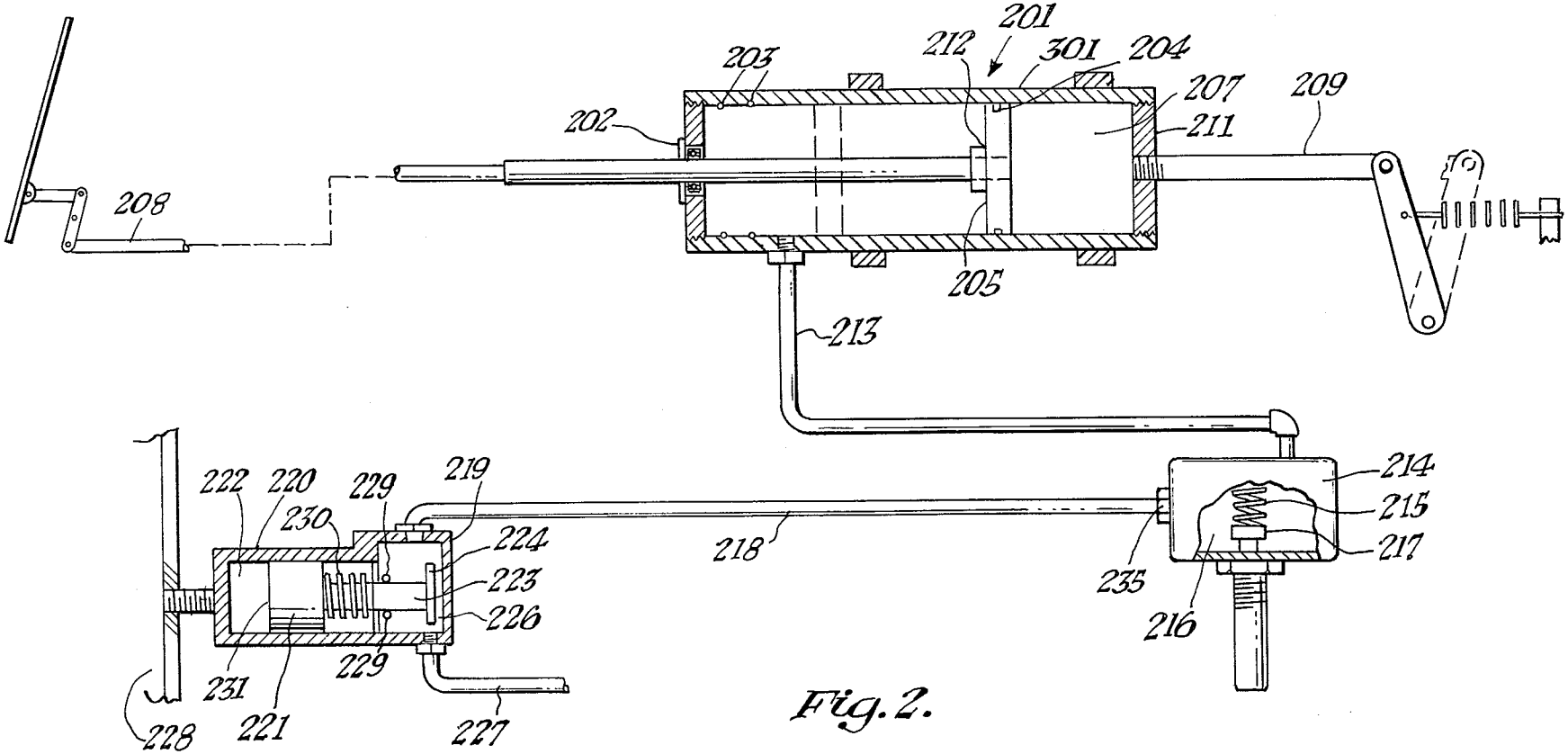
FIG. 2 is a partial sectional schematic showing the engine protection device with air pressure lines.

Referring now more particularly to the drawings in FIG. 2, and to the characters of the reference marked there on the engine protection device as used in association with an engine govenor lever, moveable in a speed increase direction, by a connecting throttle rod 209 being activated from operators control lever by a rod 208 connected between said control lever and control rod 209.

The engine protection device comprises a relativily small diameter elongated air cylinder. The air cylinder assembly 201 includes a tubular body 301 threaded end plug 211, air seal 202, control rod bushing sleeve 228 said sleeve retained by snap rings 210 and sealed with O rings 203 and a piston 212 with a piston ring 204. The related split end portion of the throttle rod 208 forming the piston rod of the cylinder slidably extending in sealed relation through the bushing 228 and inwardly thereof being attached to the piston 212. The other split end portion of the throttle rod 209 is secured to end plug 211 and a return spring 207 is to urge cylinder control rod to its idle or stop position.

A conduit 213 is attached to cylinder body 301 and leads to compressed air feed in relation to oil pressure valve 220 and air relay valve 219 and thermo valve 214. The portion of the conduit 213 which is attached to the cylinder body 301 is flexible in order to permit free longitudinal motion of the compressed air cylinder with its throttle rod 209.

An oil pressure valve 220 is connected to a source of hydraulic pressure on the engine 228 which is used to open poppet valve 223 on air relay valve 219 allowing compressed air to flow from conduit 227 into air chamber 225 through poppet valve ports and into air chamber 226. Compressed air flowing through conduit 218 and normally open thermo valve 214 is fed into control cylinder forcing piston 212 and contrl rod 208 into their operating position, while compressing return spring 207. A quick air pressure release valve located inside thermo valve 214 is used to allow compressed air to escape should low oil pressure or excessive coolant temperature occur.

The oil pressure valve 220 has a piston 221 and spring 230. The piston face 231 being urged against its seat machined in valve body 220. Oil under pressure forces piston 221 to compress spring 230 forcing poppet valve 223 to uncover its port. The oil pressure required to open said poppet valve 223 is regulated by installing shims of desired thickness between piston and piston spring.

When engine is in use the oil pressure valve 220 and compressed air valve remain open. Should engine oil pressure fall to predetermined level, piston 221 is urged against its seat bringing with it poppet valve 223 to a closed position blocking air flow to control cylinder 201. Trapped air is then released by quick release located in thermo valve 214 allowing control cylinder 201 to return control rod 209 to a low idle or stop position.

The thermo valve 214 is attached by pipe thread 235 to engine cylinder head or coolant manifold, its heat sensor being immersed in engine coolant. Compressed air flows through conduit 213 into thermo valve 214 which is normally open then led through conduit 213 into control cylinder 201. This compressed air will bring control cylinder 201 into its working or operating lengths. Should engine liquid coolant temperature rise above predetermined level or range valve 217 compressed air will compress spring 215 until valve 217 is firmly against its seat thereby stopping air flow to control cylinder 201. Compressed air is then exhausted by quick release inside thermo valve, control cylinder 201 will then return control rod 209 to its low idle of stop position.

The instant invention has been shown and described herein in what is considered to be the most practical and preferred embodiment. It is recognized, however, that departures may be made therefrom within the scope of the invention and that obvious modifications will occur to a person skilled in the art.

What I claim is:

1. An engine protection device for controlling engine speed of internal combustion engine comprising:

a throttle actuator means connectable to an engine speed regulator of the engine;

a pressure change responsive means connected between said throttle actuator means and the engine speed regulator;

a sensing means connectable to the engine, said sensing means for sensing the increase in engine temperature; and a fluid connecting means connected to said pressure change responsive means and to said sensing means, said fluid connecting means for converting temperature increases from said sensing means to physical regulation through said pressure change responsive means;

said pressure change responsive means for varying said engine speed regulator means to idle or shut down the engine by sensing increases in engine temperature such that an undesirable increase in engine temperature varies said pressure change responsive means to effect the engine speed;

said throttle actuator means includes a throttle control and said engine speed regulator; and said pressure change responsive means includes a variable fluid link means connected between said throttle control and said engine speed regulator;

said undesirable increase in engine temperature varies the pressure change responsive means to reduce the engine speed;

said variable link means includes an elongated hydraulic cylinder and a solid cylinder that fits snuggly into said elongated hydraulic cylinder;

said solid cylinder moving in response to an increase in engine temperature;

said elongated hydraulic cylinder includes a conduit for communication between said pressure change responsive means and said elongated hydraulic cylinder.

2. An engine protection device for controlling engine speed of internal combustion engine comprising:

a throttle actuator means connected to the engine to control speed of the engine;

a pressure change responsive means connected between said throttle actuator means and the engine;

a sensing means connected to the engine; and a fluid connecting means connected to said pressure change responsive means and to said sensing means;

said pressure change responsive means for sensing increases in engine temperature such that an undesirable increase in engine temperature varies pressure change responsive means to reduce the engine speed;

said throttle actuator means includes a throttle control and an engine fuel regulator; and said pressure change responsive means includes a variable fluid link means connected between said throttle control and said fuel regulator;

said undesirable increase in engine temperature shortens the pressure change responsive means to reduce the engine speed;

said variable link means includes an elongated hydraulic cylinder and a solid cylinder that fits snuggly into said elongated hydraulic cylinder;

said solid cylinder moving in response to an increase in engine temperature;

said elongated hydraulic cylinder includes a conduit for communication between said pressure change responsive means and said elongated hydraulic cylinder.

3. An engine protection device for controlling engine speed of internal combustion engine as set forth in claim 2, wherein:

said elongated hydraulic cylinder includes a second conduit for communication between the engine and said elongated hydraulic cylinder.

4. An engine protection device for controlling engine speed of internal combustion engine as set forth in claim 3 wherein:

said conduit allowing for the flow of oil between said elongated hydraulic cylinder, said pressure responsive means and said engine;

said second conduit allowing for passage of oil between said elongated hydraulic cylinder and said engine.

5. An engine protection device for controlling engine speed of internal combustion engine as set forth in claim 2, wherein:

said conduit allowing for the flow of compressed air between said elongated hydraulic cylinder;

said pressure responsive means and said engine.

* * * * *